US012714262B2

(12) United States Patent
Marvan

(10) Patent No.: US 12,714,262 B2
(45) Date of Patent: Aug. 25, 2026

(54) BATHTUB AND/OR SHOWER TRAY

(71) Applicant: Magic Bad Marvan & Marvan Produktentwicklungs—und Vertriebs GmbH, Vienna (AT)

(72) Inventor: Christoph Marvan, Vienna (AT)

(73) Assignee: Magic Bad Marvan & Marvan Produktentwicklungs—und Vertriebs GmbH, Vienna (AT)

( * ) Notice: Subject to any disclaimer, the term of this patent is extended or adjusted under 35 U.S.C. 154(b) by 106 days.

(21) Appl. No.: 18/861,657

(22) PCT Filed: Apr. 28, 2023

(86) PCT No.: PCT/AT2023/060145

§ 371 (c)(1),
(2) Date: Oct. 30, 2024

(87) PCT Pub. No.: WO2023/212762

PCT Pub. Date: Nov. 9, 2023

(65) Prior Publication Data

US 2025/0281002 A1 Sep. 11, 2025

(30) Foreign Application Priority Data

May 3, 2022 (AT) ..... A 50301/2022

(51) Int. Cl.
*A47K 3/00* (2006.01)
*A47K 3/06* (2006.01)
(Continued)

(52) U.S. Cl.
CPC ..... *A47K 3/004* (2013.01); *A47K 3/06* (2013.01); *A47K 3/162* (2013.01); *A47K 3/40* (2013.01)

(58) Field of Classification Search
CPC ..... E04H 1/1244; A47K 4/00; A47K 3/004; A47K 3/04; A47K 3/06–074; A47K 3/162; A47K 3/20; A47K 3/32; A47K 3/40
See application file for complete search history.

(56) References Cited

U.S. PATENT DOCUMENTS 3,191,190 A * 6/1965 Lowry ..... A47K 3/06 4/585
3,657,746 A * 4/1972 Downey ..... A47K 3/325 4/603
2010/0212084 A1* 8/2010 Gibson ..... A47K 3/06 4/585

FOREIGN PATENT DOCUMENTS

CH 52381 11/1911
CN 2329291 7/1999
(Continued)

OTHER PUBLICATIONS

International Search Report.

*Primary Examiner* — David P Angwin
*Assistant Examiner* — Nicholas A Ros
(74) *Attorney, Agent, or Firm* — Dunlap Bennett & Ludwig PLLC

(57) ABSTRACT

A tub and/or shower tray comprising a base part and a wall or side element, and is substantially perpendicular to the base part, the wall or side element is formed of substantially annular elements tightly fixed against one another, and which surround the base part and can be displaced in a vertical direction with respect to the base part, at least one lifting and lowering mechanism is provided on the annular element, which can be displaced with respect to the base part, the base part is surrounded by a drainage channel having drainage fittings, the annular elements are retractably arranged in the drainage channel which is formed by a lower
(Continued)

and an upper drainage-channel part, a plurality of support elements is provided in the lower drainage-channel part, and at least one drain connected to at least one water-drainage pipe is in the lower drainage-channel part.

13 Claims, 3 Drawing Sheets

(51) Int. Cl.
*A47K 3/162* (2006.01)
*A47K 3/40* (2006.01)

(56) References Cited

FOREIGN PATENT DOCUMENTS

| | | | | |
|---|---|---|---|---|
| EP | 3378366 | | 9/2018 | |
| KR | 101629922 | * | 6/2016 | ..... A47K 3/06 |

* cited by examiner

BATHTUB AND/OR SHOWER TRAY

BACKGROUND OF THE INVENTION

The present invention relates to a bathtub and/or shower tray comprising a base part as well as a wall or side element, respectively, which completely surrounds a circumference of the base part and is arranged substantially perpendicularly to the base part, wherein the wall or side element, respectively, is formed in multiple parts of substantially annular elements, which can be tightly fixed against one another, wherein all of the substantially annular elements, which surround the base part, can be displaced counter to one another in the direction of a vertical extent of the bathtub and/or shower tray as well as with respect to the base part, wherein at least one lifting and lowering mechanism is provided on and articulated to the annular element, which can be displaced the furthest with respect to the base part, wherein the base part is surrounded by a drainage channel having drainage fittings, and the annular elements are retractably arranged in the drainage channel.

Bathtubs and/or shower trays can be found in a wide variety of sizes, designs and also depths in virtually every house or every apartment, respectively, wherein the occupants' wish, a bathroom, which includes a bathtub as well as a shower tray, can mostly not come true, in particular in modern homes due to the limited available space. Both elements, the bathtub and also the shower tray have their advantages and their disadvantages. In the case of a shower tray, it is thus easy for elderly people and/or people with limited mobility to get into said shower tray, while, on the other hand, cleaning the entire body is more comfortable and easier in a bathtub, in particular in the case of limited mobility or also in the case of children, but getting into and getting out of said bathtub is hardly possible without aids, in particular for people with limited mobility, due to the high edge.

In order to make it possible for these people to be able to get into and out of a bathtub with such a depth, bathtubs have already been provided with access openings or doors, respectively, and have been made available, into and out of which the user can get easily. However, the fact that an element with such a depth, such as a conventional bathtub, is not required for showering is still a disadvantage in the case of bathtubs of this type, and, on the other hand, technical problems exist with regard to the water drainage, the cleanability of the entire bathtub and/or shower tray and so forth even if a flat or virtually flat surface for showering can be provided.

A bathtub and/or shower tray can be gathered from the EP 3378366 A, which can form a bathtub having a sufficient depth as well as a shower tray, which is formed so as to be aligned with a surrounding bathroom floor. It is disadvantageous in the case of this type of bathtub and/or shower tray that a base part is either connected to drainage fittings, so that the bathtub has to be emptied completely prior to lowering the individual interlocking elements, which form the tub, in order to prevent an overflow of water. On the other hand, it is likewise known that in a retracted state of the elements forming the tub, they are lowered into a drainage channel, in which drains are formed or at least one drain is formed, respectively, via which the water is to flow away. It is disadvantageous in the case of a formation of this type that the profiles of the tub lowered into the drainage channel almost completely fill the drainage channel, whereby a quick drainage of the water is massively impeded.

A further formation of a collapsible bathtub can be gathered from the CH-PS 52381, which consists of a tub-shaped base element and wall elements, which can be shifted telescopically, which is held by means of support elements, which can be clamped under the upper edge, in order to prevent the individual elements from unintentionally sliding into one another.

SUMMARY OF THE INVENTION

The present invention thus aims at a bathtub and/or shower tray of this type, which is formed so that its wall or side element height, respectively, can be retracted completely into the base and form a flat surface, which provides for a quick and reliable emptying of the bathtub or a complete drainage of water while showering and which can moreover be cleaned and maintained easily.

In order to thus take both needs into account in the same bathtub and/or shower tray, namely being able to provide a bathtub, into and out of which one can get easily and, on the other hand, to provide a shower tray, which forms a flat surface while showering and, on the other hand, a bathtub has a corresponding installation depth in order to be able to fill it with sufficient water in order to be able to take a full bath, it is thus necessary to provide a bathtub and/or shower tray, which can be set so that it forms a flat surface with a surrounding bathroom floor and so that it is moreover ensured that either water originating from the tub or water supplied while showering can drain securely and reliably via drains formed in or under the tub base, respectively, the bathtub and/or shower tray is substantially characterized in that the drainage channel is formed by two drainage-channel parts, which transition into one another, a lower and an upper drainage-channel part, that a plurality of support elements, which are formed to support the substantially annular elements, is provided in the lower drainage-channel part, and that at least one drain connected to at least one water-drainage pipe is formed in the lower drainage-channel part, in order to solve this object. Due to the fact the drainage channel is formed by two drainage-channel parts, which transition into one another, a lower and an upper drainage-channel part, it is possible to completely retract the substantially annular elements in the one, namely the upper drainage-channel part, whereby in the lowered state of the substantially annular elements, a shower tray is formed, which form a completely flat surface, which is aligned with a bathroom floor, for example. In that a second, in particular lower drainage-channel part, is furthermore available, the water, which is emptied from a filled bathtub or which hits the formed flat surface while showering, is discharged downwards through the upper drainage channel and is guided via the lower drainage channel into a drain, for example. It can be ensured in this way that water does not unintentionally run into the bathroom or remains standing in a drainage-channel part, as this was the case in the case of bathtubs according to the prior art, which could in fact be lowered to form a flat surface, but the channel, into which the elements forming the bathtub were retracted, could not be emptied completely due to tub elements, which impede the free drainage of water. The problems caused by water that remained standing, hair or soap residues and the like as well as problems of an unintentional water escape into the bathroom with the known disadvantageous consequences of a slippery floor, bathroom furniture or the like damaged by moisture can be reliably avoided with a formation according to the present invention.

What is understood by drainage-channel parts, which transition into one another, is that the two drainage-channel parts are separated by, for example, a step, a chamfering, a cross sectional tapering or the like, but form a common water-holding volume, in the case of which the at least partly opened upper side of the lower water-holding volume simultaneously forms a virtual continuation of a base surface of the upper water-holding volume.

A further reliability for this, as it is provided according to the invention, is provided in that a drain connected to water drainage pipes is formed in the lower drainage-channel part. It is ensured in this way that the drain is provided in the lowest part of the bathtub or shower tray and water is reliably prevented from remaining standing in any part of the device.

In that the bathtub and/or the shower tray, as it corresponds to a further development of the invention, is formed so that the substantially annular elements are formed as substantially L-shaped individual profiles, which can be engaged with each other and that sealing elements, in particular annular seals, are provided between legs of the individual profiles, which engage with one another, it is possible to form the tub of individual profiles that can be releasably connected to one another, which is tight in its upright state by inserting sealing elements between the individual profiles and to furthermore ensure that water can pass through between the individual annular elements in the lowered state of the substantially annular elements. The sealing is possible by means of the weight of the individual elements, which are hooked into each other, a connection of the substantially annular profiles to one another, for example by means of a flexible silicone element, may be omitted.

To ensure that water does not suddenly pass through between all substantially annular elements, which are only connected by means of the seals, when lowering the plurality of substantially annular elements and an excessive quantity of water flows into the drainage channel, the lowering of the substantially annular elements is done so that water first escapes between the base element and the first element, then between the first and second element, etc. This is possible in that due to the water pressure, the lowermost element first becomes disengaged from the base element and subsequently reaches its desired flat or lowered state first, respectively. It can be prevented in this way that excessive quantities of water escape simultaneously and lastly, as it corresponds to a further development of the invention, the device can be further developed, so that a plurality of sensors is provided, which control the water level in the drainage channel, the speed of the lowering of the individual annular elements and so on and immediately output a corresponding signal in the event that the water level decreases too quickly or is too high, respectively, in the drainage channel, and, in the worst case, reverse the movement in order to prevent a, for example, a flooding of a bathroom.

In practice, the substantially I-shaped elements usually correspond to an L, which is pivoted by 180° or a type of hook, respectively, so that the edge of each element, which is directed downwards, is formed to be substantially straight.

To now prevent that in particular in the case of a bathtub that is completely filled with water, i.e., in a state, in which substantially all substantially L-shaped elements are in their maximum vertical extent or are hooked into each other, respectively, that the individual substantially annular elements bulge or are preformed by the water pressure prevailing in the interior of the bathtub, respectively, the invention is further developed so that stiffening elements are provided on an outer circumference of the substantially annular elements so as to at least partly engage around them. Due to the fact that stiffening elements are provided on an outer circumference of the substantially annular elements so as to at least partly engage around them, it is possible to reliably prevent a bulging of the substantially annular elements to the outside due to the water pressure prevailing in the interior of the bathtub and/or shower tray. What is understood by stiffening elements on an outer circumference so as to at least partially engage around is that the stiffening elements are arranged on the outside of the substantially annular elements, be it screwed to them, adhered to them, formed in one piece with them, the material being stiffened or the stiffening element being incorporated in the material thickness or the like, and that so as to partly engage around in particular in the case of formations of the bathtub, which are not circular but have, for example, an elliptical shape or the like, means that the long sides or extended sides, respectively, are formed with stiffening elements. The parts of the substantially circular elements, which have a relatively large curvature, such as head parts or the like, require no stiffening elements whatsoever because they are not or only highly conditionally open to a bulging.

To provide a secure standing surface and to in particular prevent any risk of accident even if the individual substantially annular elements are in the lowered state, the invention is further developed to that effect that in a lowered state of the annular elements, the upper drain-channel part is completely covered by respective upper legs of the substantially L-shaped individual profiles. Due to the fact that the upper drainage-channel part is completely covered by respective upper legs of the substantially L-shaped individual profiles, not only a flat surface is provided but the water can drain securely and reliably through the narrow gaps, which are inevitably formed between the individual substantially L-shaped individual profiles, into the lower drainage-channel part and a leakage of water from the region of the shower tray, which is formed to be flat, is avoided. The gaps hereby form in particular because a bathtub wall is generally not formed completely vertically but has an inclined shape, with a tapering in the direction towards a base part, so that a small gap between the respective upper legs of two in the adjacent, substantially L-shaped individual profiles is formed in response to a lowering, depending on the angle of inclination between the individual substantially annular elements. According to the present invention, this small gap is used as part of a water drainage in the lowered state of the substantially annular elements.

In that, as it corresponds to a further development of the invention, the bathtub and/or shower tray is formed so that the support elements are formed as support webs or bearing nubs, it is ensured that in a retracted state of the bathtub and/or shower tray, the substantially annular elements rest on the support webs or bearing nubs and an impediment of a free drainage of water into the lower drainage-channel part cannot take place. To prevent an accumulation at the bearing nubs or support webs, respectively, the formation can hereby be made so that a drain, which is connected to a central drain arranged under the bathtub or shower tray, respectively, is in each case provided between more than two support webs or a row of bearing nubs, so that water can flow into the central drain from a plurality of directions. In the case of a formation of this type, it is not only ensured that even large quantities of water can drain quickly and reliably, but in particular that an overflow of the drainage channel is reliably prevented.

In that, as it corresponds to a further development of the invention, the formation is made so that the support webs are formed as webs, which bridge the lower drainage-channel part and which are releasably fixed therein, a further simplification of the device can be provided, in the case of which the provision of several drainage openings can be avoided, but the entire lower drainage-channel part is available for taking up water, which can flow freely in this lower drainage-channel part and it is thus ensured, in turn, that a quick drainage of the water is ensured at the or the provided drainage openings, respectively. In that the support webs are furthermore formed as reliably fixed webs, they can be removed easily, for example for maintenance or cleaning purposes, whereby a hygienic formation is also made because it is ensured that no residues whatsoever, such as hair or the like, can accumulate on the webs or they can be cleaned quickly and easily, respectively.

For a further reliability of the bathtub and/or shower tray, the invention is formed so that the support webs have a number of depressions or notches, which corresponds to a number of annular elements. In that the support webs have a number of depressions or notches, which corresponds to the number of annular elements, it is ensured in a lowered state of the bathtub and/or shower tray that each annular substantially L-shaped element is arranged in one of the notches or depressions, respectively, whereby a shifting of the individual substantially annular elements counter to one another is reliably avoided and larger gaps can thus also not be formed unintentionally in the flat base surface, which only has narrow drainage gaps.

In the same way, the formation, as it corresponds to a further development of the invention, can be made so that the bearing nubs are arranged spaced apart from one another on a base surface of the lower drainage channel and that a plurality of groups of bearing nubs is provided, wherein a group of bearing nubs is in each case arranged next to one another so as to extend in the radial direction of the lower drainage channel and in a number corresponding to the number of annular elements. In that a plurality of bearing nubs are arranged at a distance from one another on a base surface of the lower drainage channel, it is possible to provide bearing nubs for the substantially annular elements and to simultaneously ensure that the water drainage in the interior of the lower drainage channel is not relocated and the water can flow through the free space between the individual nubs. In that a plurality of groups of bearing nubs are simultaneously arranged so as to extend in the radial direction of the lower drainage channel and these groups of the number of annular elements have a corresponding number of bearing nubs next to one another, a plurality of bearing points is provided for each individual one of the annular elements and it is thus ensured that no unintentional inclining or bending, respectively, of the individual elements takes place even in the case of a load on the upper side of the substantially annular elements, e.g., when the bathtub and/or shower tray is in the lowered state and is used as shower tray, and a smooth and flat base can thus be provided without any difference in level.

In that, as it corresponds to a further development of the bathtub and/or shower tray, the formation is made so that the base part is formed by at least one box-shaped element, which is formed to be substantially hollow, as well as a substantially plate-shaped element releasably fixed thereto, the total weight of the bathtub and/or shower tray is reduced as well as a fixed or rigid base, respectively, is provided, which does not bend under weight, be it the weight of the water, the weight of one or several users and furthermore has an aesthetically pleasing appearance.

In that, as it corresponds to a further development of the invention, control or regulating elements, respectively, in particular the elements for controlling the lifting and/or lowering of the substantially annular elements, are arranged in the interior of the box-shaped element, which is formed to be substantially hollow, it is not necessary to provide a separate operating box for controlling the bathtub and/or shower tray. It goes without saying that not only the control or regulation, respectively, for the height adjustment of the shower tray and/or bathtub can be provided in the box-shaped element, which is formed to be substantially hollow, but also the control about the quantity and/or temperature of the required water, a large variety of sensor elements and so on, be it to be able to operate the bathtub and/or shower tray with remote control, with the mobile phone or in any other way, be it to switch between a water inlet for a bath or one for a shower and so on. It goes without saying that the classic operation thereof by means of, for example, push buttons for lifting or lowering the tub or classic faucets is also possible. All further elements for the water inlet, faucets or the like can also be included in the box-shaped element, which is formed to be hollow. In the case of a formation of this type, it is furthermore ensured that no moisture can reach into the interior of the substantially box-shaped element in that the element, which is formed to be substantially plate-shaped, is covered with a substantially plate-shaped element fixed thereto, and that no locking elements whatsoever or other fixing elements are visible on a surface facing the interior of the bathtub and/or shower tray, and an easy cleaning of the entire base part of the bathtub or shower tray, respectively, is lastly possible by means of a formation of this type.

In that, as it corresponds to a further development of the invention, the device is formed so that the base part has a plurality of nozzles, in particular air and/or water supply nozzles, it is possible to use the bathtub and/or shower tray directly as whirlpool or massage tub, respectively, without changes having to be made to the substantially annular profiles or drainage channels.

When, as it corresponds to a further development of the invention, the lifting and lowering mechanism is formed by at least two electrically, hydraulically or pneumatically operable lifting cylinders, which can in particular be operated by means of remote control, a one-sided lifting of the bathtub is reliably prevented. The formation can hereby be made in the way it is known per say, so that the respective lifting and/or lowering mechanism engages with the uppermost substantially annular element and ensures a lowering or lifting. It is not necessary to note that the uppermost substantially annular element as well as the drainage-channel part requires a stiffening in the region of the lifting and lowering mechanism in order to reliably prevent a tear-out of the elements, which are usually made of plastic. In consideration of the fact that stiffening elements of this type can either extend over the entire circumference of the uppermost substantially annular element and of the drainage-channel part or are only formed locally and can be selected from any materials or options, respectively, a more in-depth discussion of these stiffening elements is not necessary.

The entire bathtub and/or shower tray can hereby either be operated by means of remote control or classically by means of operating buttons and an electric control. It goes without saying that any variations of sensor control, controls via mobile phone or remote control, pre-programmable filling or emptying times, respectively, and so on are possible. Due to the fact that control or regulating elements of this type, respectively, or also programmable elements are to the person of skill in the art, a more in-depth discussion of them is not necessary.

DESCRIPTION OF THE DRAWINGS

The invention will be described in more detail below on the basis of exemplary embodiments illustrated in the drawing, in which.

DETAILED DESCRIPTION OF THE INVENTION

Figure 1:
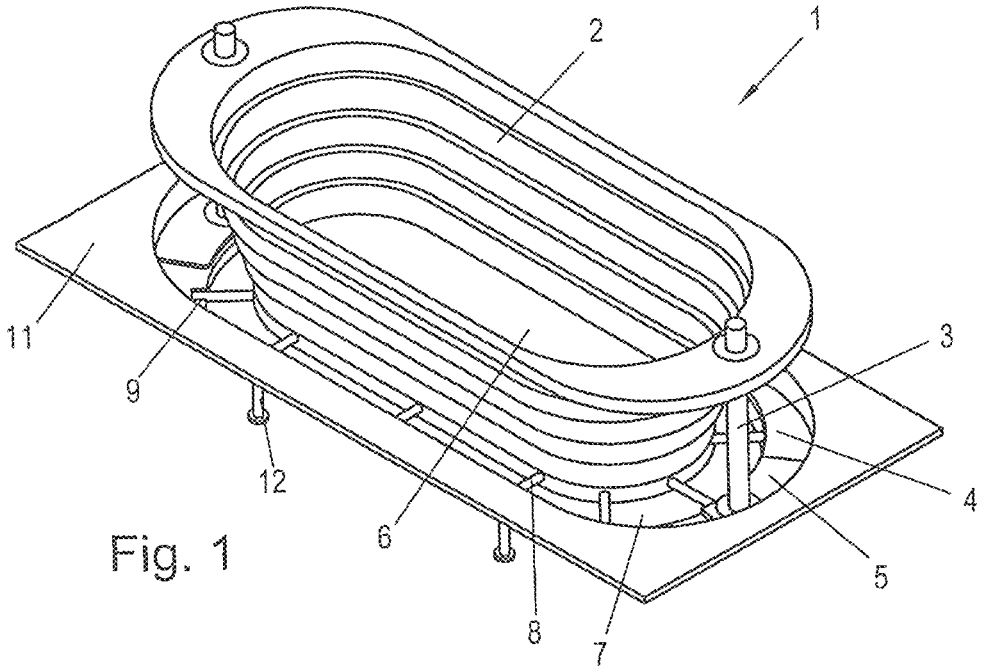
FIG. 1 shows a perspective view of the bathtub and/or shower tray according to the invention.

In FIG. 1, 1 generally identifies a bathtub and/or shower tray, which, in the present case, is formed by five substantially annular elements 2, which can be pushed into each other or pushed apart, respectively. In the case of the illustration of FIG. 1, the substantially annular elements 2 are shown in the maximally pushed-apart state, so that a bathtub 1 with conventional depth of between 35 cm and 50 cm was formed. The height adjustment of the bathtub or shower tray 1, respectively, hereby takes place by means of a lifting or lowering mechanism 3, respectively, which engages with the uppermost annular element 2, wherein the uppermost annular element 2 is formed to be reinforced for the engagement of the lifting and lowering mechanism 3 as well as a reinforcing element 5 for the lifting or lowering mechanism 3, respectively, is provided in the upper drainage channel 4. The bathtub or shower tray 1, respectively, according to FIG. 1 is hereby formed so that the lowermost, substantially annular element 2 engages with a base part 6, wherein according to the invention, the base part 6 is aligned with, for example, a bathroom floor, which is not illustrated, and is formed on a plane, in order to attain a surface, which is formed to be flush with the bathroom floor, in the pushed-together state of the substantially annular elements 2.

So that a single plane with the base part 6 of the bathtub and/or shower tray 1 can be formed in the pushed-together state of the substantially annular elements 2, a water-drainage channel 4 has to be provided under the bathtub and/or shower tray 1, the depth of which corresponds at least to the height of the individual substantially annular elements 2. According to the invention, the water-drainage channel 4 is now formed so that it is formed by two drainage-channel parts 4 and 7, which transition into one another, a lower 7 and an upper 4 drainage-channel part. A plurality of support elements 8 is provided in the lower drainage-channel part 7, on which the individual substantially annular elements 2 rest in the lowered state of the bathtub and/or shower tray 1. In the shown embodiment, the support elements 8 are formed as webs or the like, which bridge the lower drainage-channel part 7 and which are inserted into depression 9 of the lower drainage-channel part 7. The support elements 8 can also be formed with nubs or as webs, which are screwed in or which are tightly plugged into corresponding recesses, respectively. The support elements 8 furthermore have a number of ribs 10, which corresponds to the number of substantially annular elements 2, in order to provide for a displacement-free resting of the individual elements 2 in the lowered state of the bathtub and/or shower tray 1.

Any type of lifting cylinders can be used hereby as lifting or lower mechanism 3, respectively, such as, for example, hydraulically, pneumatically or electrically operated lifting cylinders. It is important to note in this context that in particular the weight, which has to be held with lifting and lowering mechanisms 3 of this type, is relatively small because, for example in the case of plastic bathtubs, the substantially annular elements 2 only have a very small weight and the forces acting on the bathtub or shower tray 1, respectively, in the vertical direction are thus relatively small.

In FIG. 1, the tray 11 comprising the drainage channels 4, 7 is furthermore provided formed with feet, in particular height-adjustable feet 12, in the region around the upper drainage-channel part 4, in order to be able to provide an in particular 100% horizontal formation of the bathtub and/or shower tray 1.

Lastly, as it is likewise not illustrated in the present formation, the bathtub or shower tray 1, respectively, can be covered with a cover element in order to increase the esthetic on its outer side.

Figure 2:
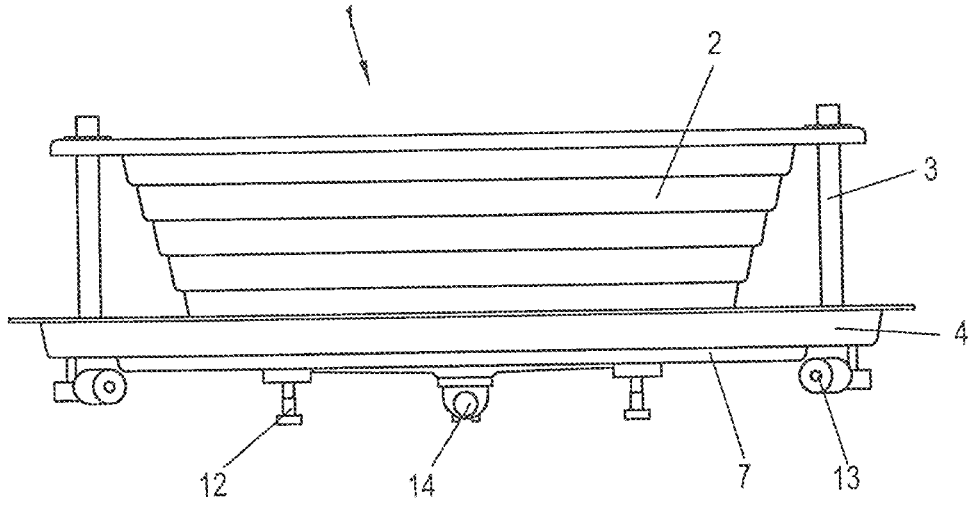
FIG. 2 shows a side view of the bathtub and/or shower tray of FIG. 1.

The reference numerals of FIG. 1 have substantially been maintained in FIG. 2, wherein the bathtub and/or shower tray 1 is shown as view from the side, wherein the design located under the tray 11 is additionally also shown. In addition to the elements already shown in FIG. 1, a drive unit 13 for the lifting and lowering mechanism 3 is furthermore shown schematically FIG. 2, as well as a drain 14, so that the water flowing into the lower water-drainage channel 7 can drain reliably.

Figure 3:
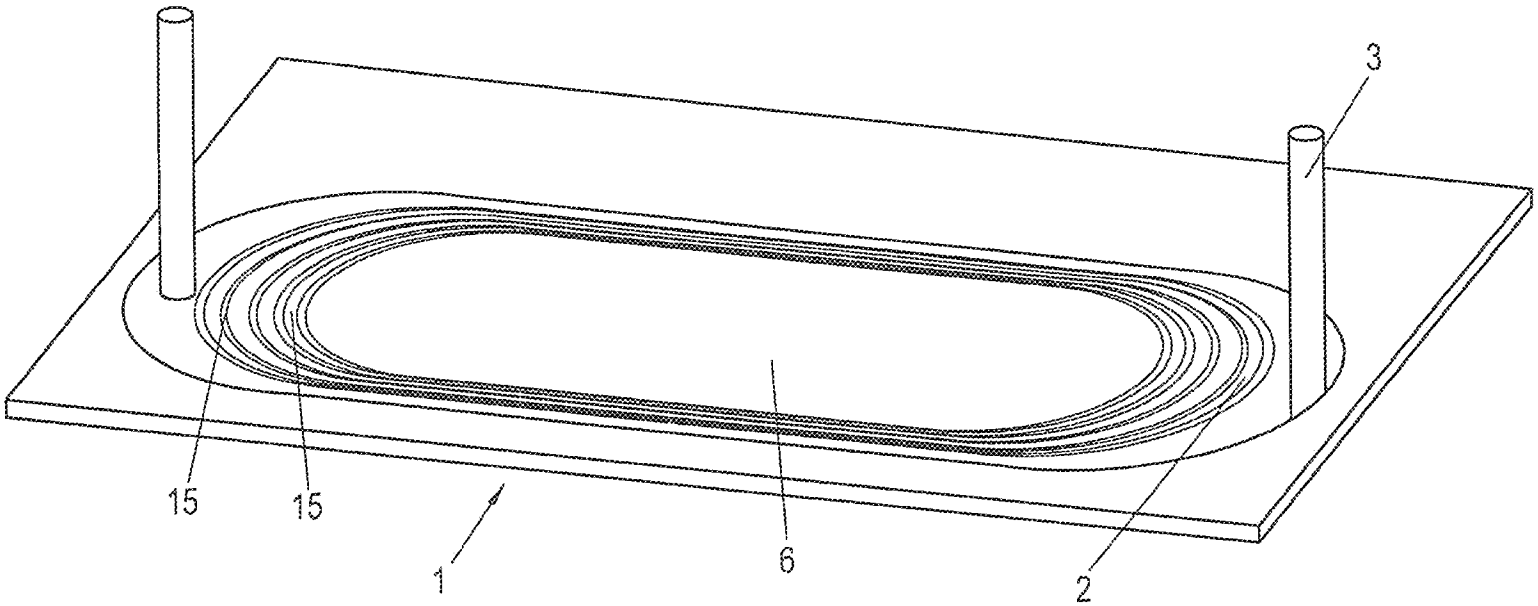
FIG. 3 shows a view from the top of the bathtub and/or shower tray in the lowered state.

In FIG. 3, the bathtub and/or shower tray 1 is illustrated in its collapsed or pushed-together state, respectively, of the annular elements 2, wherein the base part 6 is arranged on a plane with the substantially annular elements 2, which are retracted in the drainage channel 4, and the respective upper legs 15 of the substantially L-shaped profiles of the substantially annular elements 2 are hereby formed so that the drainage channel 4, 7 is completely covered by these upper legs 15, so that a risk of accidents in particular when getting into the base element 6 of the bathtub and/or shower tray 1 is prevented as much as possible. It is not necessary to note that a formation of the bathtub and/or shower tray 1 of this type can be used directly as shower, in that wastewater originating from showering flows into the drainage channel 4, 7 between the substantially annular elements 2 and is transported away from there via the drain 14.

Figure 4:
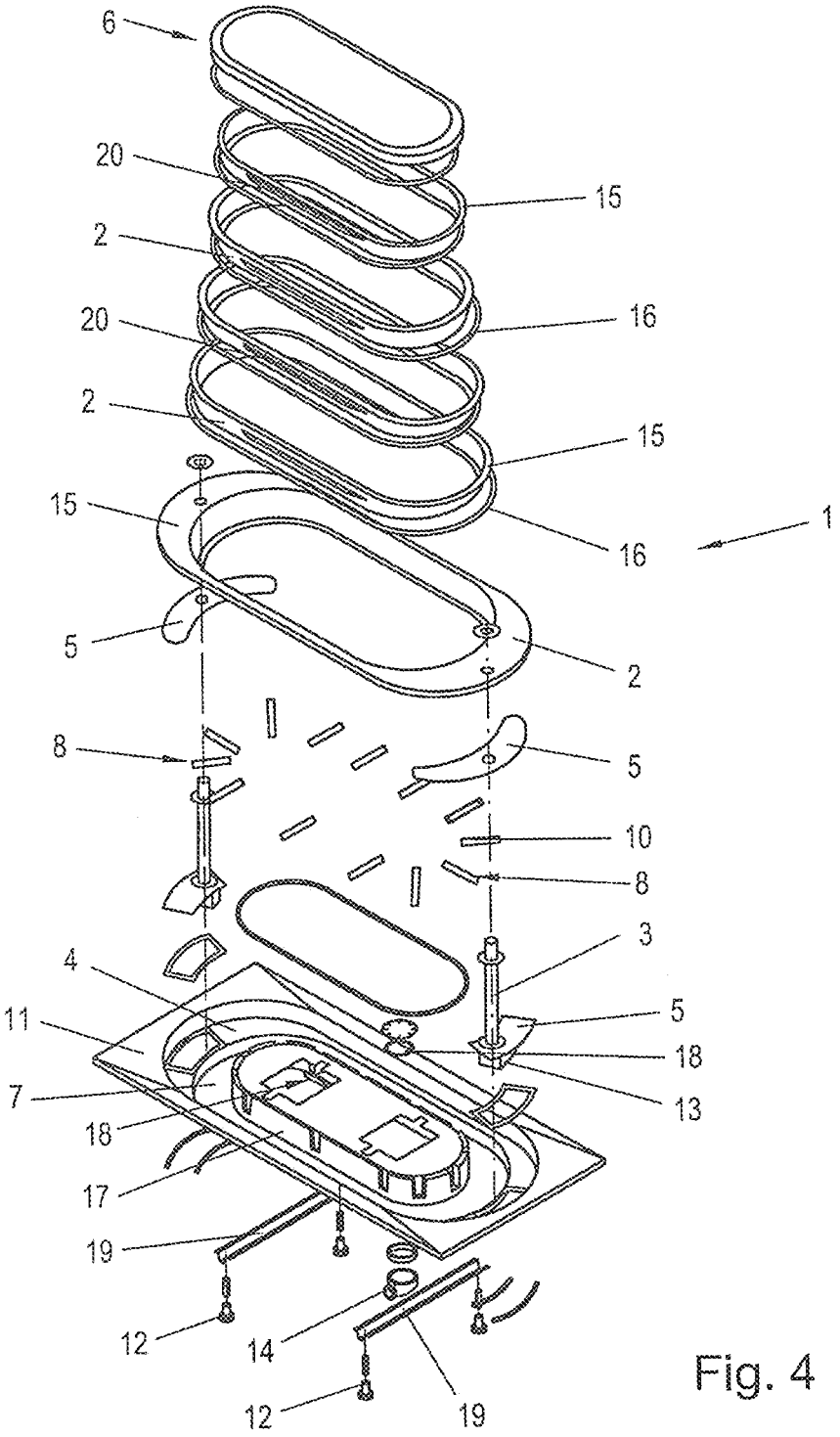
FIG. 4 shows an exploded view of the individual elements forming a variation of the bathtub and/or shower tray.

An exploded view, which shows the individual elements forming a variation of the bathtub and/or shower tray 1, is illustrated in FIG. 4. In addition to the elements, which are essential for the formation of the bathtub and/or shower tray 1, a height adjustment for the feet 12, seals for the reinforcing elements 5 of the lifting and lowering mechanisms 3, fixing elements and the like, for example, are also suggested in this exploded illustration, but which are not essential for the mode of operation of the bathtub and/or shower tray 1 and which are thus not described separately.

In detail, it can be seen from FIG. 4 that each substantially annular element 2 is formed with an upper edge 15, into which upper edge 15 a seal 16 is inserted in each case. However, the substantially annular elements 2 can also be formed to be substantially Z-shaped, wherein a lower edge, which is not shown in FIG. 4, would additionally be formed. On the one hand, this substantially Z-shaped formation of the substantially annular elements 2 is difficult to clean because water always remains standing in the lower channel of the Z and, on the other hand, the free drainage of water is made slightly more difficult. Due to the substantially L-shaped or Z-shaped formation of the substantially annular elements 2, two substantially annular elements 2 following each other in the vertical direction are only connected by means of the inserted seal 16, so that the elements 2 become disengaged from one another during the lowering and water passes through between the substantially annular elements 2. To prevent a bulging of the substantially annular elements 2 due to the water pressure prevailing in a filled bathtub 1, the respective long sides of the bathtub and/or shower tray 1 with stiffening elements 20 are furthermore provided. The stiffening elements 20 are hereby preferably metal stiffenings incorporated in the material thickness of each substantially annular element 2. Lastly, the elements 20 could also be formed as material reinforcements.

It can furthermore be seen clearly from FIG. 4 that the uppermost annular element 2 has a significantly wide edge 15 of the substantially L-shaped element than the further substantially annular elements 2. Stiffening elements 5, through which the lifting and lowering mechanisms 3 pass, in the same way as through the edge 15, in order to provide for a lifting and lowering of the bathtub and/or shower tray 1, are provided under this wide edge 15.

A substantially box-shaped element 17, which corresponds to the shape of the bathtub and/or shower tray 1, which substantially box-shaped element 17 is formed to be hollow and has two access openings 18 in order to get into the interior thereof, can be seen in the interior of the tray 11. For example, control elements, drive elements for the lifting or lowering mechanism 3 or the like, which are not illustrated, can be provided in this interior. The substantially box-shaped element 17 is covered by the plate-shaped element of the base part 6 and is sealed by inserting a seal 16. The base part 6 is hereby releasably fixed to the substantially box-shaped element 17.

Lastly, drainage fittings 18 as well as the drain 14, which is formed for the connection to a non-illustrated pipe system, as well as carrier elements 19, which can be attached under the tray 11, can also be gathered from FIG. 4 in addition to the support elements 8.

A bathtub and/or shower tray 1 of this type is not only characterized by an extremely flexible possible use, but has in particular the advantage that it is created in a completely barrier-free manner and can simultaneously serve as full-fledged bathtub and any water located in the tub can furthermore be transported away securely.

The invention claimed is:

1. A bathing device that is alternatively configurable as a bathtub and as a shower tray, said bathing device comprising:

a base part, and a side element which completely surrounds a circumference of the base part and is arranged substantially perpendicularly to the base part, the side element being formed in multiple pieces of substantially annular elements, which are tightly fixed against one another, all of the substantially annular elements, which surround the base part, being displaceable relative to one another in a direction of a vertical extent of the bathing device as well as with respect to the base part;

at least one lifting and lowering mechanism being provided on and articulated to the substantially annular elements, which are displaceable the farthest with respect to the base part;

the base part being surrounded by a drainage channel having drainage fittings, and the substantially annular elements being retractably arranged in the drainage channel, the drainage channel being formed by two drainage-channel parts, which transition into one another, a lower and an upper drainage-channel part; and a plurality of support elements, which are formed to support the substantially annular elements, being provided in the lower drainage-channel part, and at least one drain connected to at least one water-drainage pipe being provided in the lower drainage-channel part.

2. The bathing device according to claim 1, wherein the substantially annular elements are formed with substantially L-shaped individual profiles, which are engageable with each other, and further comprising sealing elements, which are annular seals, being provided between legs of the L-shaped individual profiles, which engage with one another.

3. The bathing device according to claim 1, further comprising stiffening elements provided on an outer circumference of the substantially annular elements so as to at least partly engage around the substantially annular elements.

4. The bathing device according to claim 2, wherein in a retracted state of the substantially annular elements, the upper drainage-channel part is completely covered by respective upper legs of the substantially L-shaped individual profiles.

5. The bathing device according to claim 1, wherein the support elements are formed as support webs or bearing nubs.

6. The bathing device according to claim 5, wherein the support webs are formed as webs, which bridge the lower drainage-channel part and which are releasably fixed therein.

7. The bathing device according to claim 5, wherein the support webs have a plurality of depressions or notches, which correspond in number to the number of multiple pieces of the substantially annular elements.

8. The bathing device according to claim 5, wherein the bearing nubs are arranged at a distance from one another on a base surface of the lower drainage channel, with a plurality of groups of the bearing nubs being provided, with the group of bearing nubs in each case being arranged next to one another so as to extend in a radial direction of the lower drainage channel, and with a number of the bearing nubs corresponding to a number of the substantially annular elements.

9. The bathing device according to claim 1, wherein the base part is formed by at least one box-shaped element, which is formed to be substantially hollow, and a substantially plate-shaped element releasably fixed thereto.

10. The bathing device according to claim 9, further comprising a control or regulating elements for controlling the lifting and/or lowering of the substantially annular elements, arranged in an interior of the at least one box-shaped element.

11. The bathing device according to claim 1, wherein the base part has a plurality of air and/or water supply nozzles.

12. The bathing device according to claim 1, wherein the at least one lifting and lowering mechanism includes at least two electrically, hydraulically, or pneumatically operable lifting cylinders, which are operable via remote control.

13. The bathing device according to claim 1, further comprising a plurality of pressure sensors configured to operate with fill level sensors or moisture sensors.

* * * * *